US009165545B2

(12) United States Patent
Gelvin

(10) Patent No.: US 9,165,545 B2
(45) Date of Patent: Oct. 20, 2015

(54) PICKUP FOR STRINGED INSTRUMENT

(71) Applicant: William Gelvin, San Diego, CA (US)

(72) Inventor: William Gelvin, San Diego, CA (US)

( * ) Notice: Subject to any disclaimer, the term of this patent is extended or adjusted under 35 U.S.C. 154(b) by 196 days.

(21) Appl. No.: 13/783,935

(22) Filed: Mar. 4, 2013

(65) Prior Publication Data

US 2014/0245877 A1 Sep. 4, 2014

(51) Int. Cl.
*G10H 3/14* (2006.01)
*G10H 3/18* (2006.01)

(52) U.S. Cl.
CPC ..... *G10H 3/181* (2013.01); *G10H 2220/505* (2013.01)

(58) Field of Classification Search
CPC .... H01F 27/42; G10H 3/18; G10H 2220/525; G10H 3/181; G10H 2220/511; G10H 1/0555; G10H 3/09; G10H 1/06; G10H 1/18; G10H 3/186; G10D 3/146; G10G 1/00
See application file for complete search history.

(56) References Cited

U.S. PATENT DOCUMENTS

| | | | | |
|---|---|---|---|---|
| 5,789,691 | A * | 8/1998 | Stich | 84/726 |
| 6,034,316 | A * | 3/2000 | Hoover | 84/738 |
| 2002/0020281 | A1 * | 2/2002 | Devers | 84/728 |
| 2002/0069749 | A1 * | 6/2002 | Hoover et al. | 84/738 |
| 2005/0109197 | A1 * | 5/2005 | Garrett et al. | 84/726 |
| 2010/0181845 | A1 * | 7/2010 | Fiorello et al. | 307/104 |
| 2014/0225449 | A1 * | 8/2014 | Kurs | 307/104 |
| 2014/0245877 | A1 * | 9/2014 | Gelvin | 84/727 |

* cited by examiner

*Primary Examiner* — Marlon Fletcher
(74) *Attorney, Agent, or Firm* — Donn K. Harms

(57) ABSTRACT

A pickup for engagement to the body of an instrument having metal strings, such as a guitar in position proximate to the strings. The pickup features a coil having loops of wire wound around a recess having a magnetic member therein which projects a magnetic field to magnetize the strings. The electrical current in said coil wire induced by a movement the strings generates a first electrical signal from said first end of the coil wire and corresponding AC second electric signal from said second end of the coil wire. One or a plurality of tap wires engaged to the coil wire at tap points, provide additional individual electronic signals which may be mixed, or may be communicated individually to an amplifier or mixing component.

8 Claims, 4 Drawing Sheets

PICKUP FOR STRINGED INSTRUMENT

This application claims priority to U.S. Provisional Application No. 61/661,218, filed on Jun. 18, 2012, which is included herein in its entirety by this reference.

BACKGROUND OF THE INVENTION

1. Field of the Invention

The present invention relates to stringed instruments. More particularly, the disclosed device and method of employment thereof, relates to a pickup for stringed instruments, in particular guitar pickup devices for electric guitars. The present invention provides a customizable pickup device by employing means for varying the induced voltage communicated through the wire forming the coil of the device to one or a plurality of output signal lead ends. In one mode the means for varying the induced voltage is provided by the operative engagement of one or a plurality of tap wires communicating with the output wire lead end, engaged at different points along the length of wire forming the coil of the pickup, which produces different signals at each output lead end depending on the location of the tap connection.

2. Prior Art

Stringed instruments have been employed by musicians for centuries. Amplification of such instruments has been employed since the early 1900's when tubes were invented which could amplify input sound from microphones. Between 1920 to 1950, the need for guitar amplification increased where musicians desired to employ guitars to accompany the louder instruments of a big band style orchestra. Over time, the amplification of guitars and later, other stringed instruments, evolved to employ guitar pickups, on solid body guitars.

There exists a wide variety of guitar pickup designs available to the average consumer. One conventionally known guitar pickup is a passive magnetic pickup design employing the physics of electromagnetic induction to generate an electronic signal which is communicated to an amplifier for reproduction by loudspeakers. Other designs include piezoelectric pickups and optical pickups, however are conventionally employed for specialized purposes and are not widely used. Additionally employed to electrify the sound of some stringed instruments such as a guitar, are microphones, which are mounted internally with acoustic guitars and other similar stringed instruments such as a base.

Magnetic pickups used for guitars and other metal-stringed instruments, consist of or generally employ a permanent magnet with a core of material such as alnico or ceramic which is coupled with one or plurality of ferromagnetic pole pieces. The magnet and pole pieces are coiled with several thousand turns of fine wire and up to 10,000 turns. The pole pieces and coil are conventionally engaged on an elongated bobbin.

The coil generally comprises an electrical circuit which is acted upon by the magnetic fields of the permanent magnet and pole pieces. Like any electrical circuit placed near a changing magnetic filed, and in accordance with the basic laws of electricity and magnetism, the coils of the pickup will have an inductance, measured in Henries. The inductance can be anything from 1 Henry for a low output single coil pickup, to around 9 Henries or more, for the high output style humbucker pickups. The inductance depends on the number of turns of copper wire and also on the physical shape of the coils.

Additionally, every pickup coil has a characteristic DC resistance, measured in Ohms. Like Henries, the resistance measurement also depends on the number of turns and the diameter of the copper wire used. Typical values can range from about 1k (1000 ohms) up to about 15 k (15000 ohms).

Pickups are also known exhibit a "distributed" capacitance which is effectively in parallel with the inductance of the formed coil. This is caused by the addition of the very small capacitance between each turn on the coil.

The electrical signal output of a guitar pickup for amplification is provided by an analog signal communicated by electric current which is induced or generated in the coils when the magnetic field communicating with and through the coil (magnetic flux) changes. This is referred to as electromagnetic induction. When the pickup is operatively engaged to a body, adjacent to the vibrating metal strings of the stringed instrument, as the stringed instrument is strummed, the vibration and resulting movement of the strings adjacent the pickup modulates the magnetic field thereby inducing changes in the magnetic flux communicating through the coil. As such, in accordance with the laws of electromagnetic induction, this change in magnetic flux induces an alternating current signal through the coil. Lead ends of the coil are then communicated to an audio output and the electronic signal is ultimately communicated to an amplifier for producing the sounds and tones we hear today.

The material, length, gauge, and number of turns of the wire, leading to the point where the electric current or signal is captured and then communicated to an amplifier, can provide a change in the electrical signal output, namely in the capacitance, inductance and electrical voltage and current of the coil acting as an electrical circuit. These factors ultimately affect the electrical circuit characteristics of the coil, which affects the induced electrical signals providing the amplified sound and tone.

As such, manufacturers are able to produce different sounds and tone by varying the length, gauge, and number of turns of the wire forming the coil and the pickup locations on the body along the length of the strings. On some deigns there are additionally included magnetic pole pieces which, when engaged to the body of the guitar align with the strings. Conventional pole pieces can be adjustable, such as a threaded screw, or fixed and referred to as slugs.

The configuration of the pickup has changed only slightly since its first invention. A single coil pickup (employing a single coil configuration) is known in the art to be prone to electromagnetic interference generated by electrical power cables, power transformers, radio stations, and cathode ray tubes and other local sources. What is produced is an audible hum as a consequence of the interference with the windings of the pickup.

To overcome this effect, two sets of coils, pole pieces, and bobbin configurations are positioned on opposite sides of a permanent magnet, with one on the north magnetic pole of the magnet and one on the south magnetic pole of the magnet. Further each coil configuration is typically coiled reverse to one another. Due to the reverse windings in each pickup coil, and the positioning of the coils on the opposite poles of the magnet, the electro-magnetic interference signals in each pickup are equal yet in opposite phases, resulting in a cancelling of each other out, and eliminating the audible hum. This is commonly referred to as a 'humbucker' type pickup configuration. Examples can be found in U.S. Pat. Nos. 2,892,371 and 2,896,491 herein incorporated in their entirety by reference. Manufacturers are able to prologue various sounds and tones by employing various combination of single coil pickups and humbucking pickups, arranged at various locations on the body of the guitar.

Although advancements in pickup technology are present, for both single coil pickups and humbucker pickups, the coil configurations continue to stay unchanged. For example, for a humbucker, after winding, the end lead wires of each of the two coil configuration are engaged such that the coils are in series and there is a single output. As such, the induced signal is generated, and therefor sound and tone is produced which is limited by the number of turns between the start and end leads of the wire in each coil configuration. Therefor variations in sound and tone produced in the communicated electronic signal, are generally limited to number of turns, wire material, length, and wire gauge.

For example, classical musicians tend to employ pickups with relatively low number of turns of the wire forming the coil. This generally lowers the resistance through the coil and decreases the induced output voltage of the pickup, however this also allows for increasing the resonant peak. Therefor, lesser turns or windings on the coil, or coils depending on the pickup, is known to produce cleaner high frequency tones favored by country and blues musicians.

Rock musicians tend to use a pickup with a relatively high number of turns of the coil. This increases the output voltage and reduces the resonant peak and is more favorable with amplification of low, bass sounds. The high frequency sounds begin to get cut off and/or distorted. Over winding of the wire forming the coil is also employed. This produces clipping in the signal and even more of the familiar distortion in the amplified sound from the communicated signal, heard in heavy metal and rock music.

As such, musicians must selectively choose the type and configuration of the pickup employed on their instrument in order to get the sound and tone they desire. If a wide range of tones and resonate peaks over varying frequencies are desired, the musician typically purchases separate instruments having the desired pickup configuration which will communicate the electronic signal for amplification for each desired tone and range. Otherwise, the musician is limited to only one certain tone and range which is determined and limited by the pickup configuration employed on their instrument.

Consequently, there is an unmet need for a pickup employing a coil circuitry, which will allow communication of signals for amplification which are employable by all types of musicians, and music. Such a pickup should be configured for user customized sound generating electronic signals, by individual selection or mixing of both clean signals and distorted signals from the same pickup device. Such a device should allow for switching and resulting operative engagement of one or a plurality of output signal wires from their engagement positions at different points along the windings of wire forming the coil of the pickup to thereby vary the signal communicated for amplification to produce the desired sound.

The disclosed device herein has met a previously unmet need for an improved user-variable guitar pickup device which provides string sound signals in multiple types and tones, with both higher and lower resonant peaks all from the same pickup. The device herein described and disclosed advantageously allows a user to employ multiple audio outputs corresponding to each output lead which can be used individually or combined to create an output signal yielding customized tones and sounds. Further, by communicating the plurality of signals into a mixing knob or switch, or directly to a computer or MIDI conversion component, another increase the musician's choice of tone and sound is provided logarithmically, as compared from conventional two wire outputs.

In the device herein, each output signal wire produces different signals dependent on the location of the signal wire connection at the various points along its total length within the magnetic flux field of the pickup, thereby yielding great utility. This configuration provides a plurality of output signal wires communicating a plurality of unique electrical signals captured at these connection points or taps, to a plurality of respective individual output leads. Each output lead communicates a unique signal which can be in the clean range when the tap is at a point of relatively low number windings of the coil, all the way to the distorted range when the tap is at a point of relatively high number of windings of the coil of the pickup device. This configuration yields a wide range of tones and sounds which can be produced from a single pickup configuration.

For example, using the configuration of pickup herein, and a plurality of tap points on the coiled wire, which extend from different positions along the length of the coil of the pickup corresponding to a different number of turns, individual respective communications of different respective induced voltages and currents are provided. These may be used singularly or in combination to produce one or a plurality of output signals for amplification to produce an infinite number of different tones and sounds when communicated to an amplifier.

The forgoing examples of related art and limitation related therewith are intended to be illustrative and not exclusive, and they do not imply any limitations on the invention described and claimed herein. Various limitations of the related art will become apparent to those skilled in the art upon a reading and understanding of the specification below and the accompanying drawings.

SUMMARY OF THE INVENTION

The device herein disclosed and described provides a solution to the shortcomings in prior art and achieves the above noted goals through the provision of guitar pickup device having a coil configuration providing means for variable inductance with a resulting variance in the electrical signal generated for communication to an amplifier. The device is configurable in either of the two conventional styles of stringed instrument pickup and is particularly well employed with a type of humbucker pickup, having two coil configurations engaged on opposing magnetic poles of a permanent bar magnet. The coils are formed by wrapping wire about an elongated non magnetic bobbin.

In one preferred mode, one coil configuration includes a plurality of fixed slugs employed as pole pieces which extend through the bobbin to an engagement with the permanent bar magnet disposed underneath the coil configuration. The second coil configuration preferably includes adjustable screw members employed as adjustable pole pieces which extend through threaded apertures formed in the bobbin for communicating the pole pieces to a magnetic engagement with the bar magnet positioned below.

In another mode, the variable inductance means is provided by one or a plurality of wire taps which are electrically engaged to and extend from various locations of the wrapped wire forming the coil of the pickup device. The wire of each coil configuration is wrapped around the bobbin for thousands to tens of thousands of turns. Individual taps are engaged to various locations and therefor at various intervals of turns of the wires. As such, each wire tap will communicate at a position corresponding to a different number of wire turns and therefor the induced output voltage of each tap wire will accordingly vary, producing different a signal communicable to an amplifier to produce varying sounds and tones.

Further, by employing a humbucker configuration, that is, having each coil positioned on opposing magnetic poles of a respective bar magnet, the electromagnetic interference and therefor audible hum is eliminated as is conventionally known in the art.

In the present invention, the tap points for wires leading therefrom are located at similar intervals on each of the two humbucker coil configurations can be wired together in series, and the overall configured device will have a plurality of output leads communicating an electronic signal from its tap position. These outputs then can be engaged to terminals of multi-throw switches or operatively through adjustable knobs such as potentiometers which allow the user to adjust and select the desired output signal, to produce the amplified sound, corresponding to a one or a combination of tap wires located at tap points at a certain number of turns of the wire and therefor generate an electronic signal amplified to a particular tone. Alternatively, each output lead from its electrical engagement at a tap point, can be engaged to an individual audio output cable which can then be plugged directly into an amplifier or recording device or mixing device to produce the user's desired sound and tone. Other wiring and circuitry configuration are also considered and described in more detail later.

In another preferred mode, the gauge or diameter of the wire employed for wrapping and forming the coil, is varied for each aggregate length and number of winds, between each tap location.

For example, a 42 gauge wire can wrapped at approximately 2,000 turns to a tap point where a first tap wire is engaged, then a 44 gauge wire can complete an additional 2,000 turns following the first tap location, where at a second tap point, a second tap wire in engaged, and so on. It is noted that the number of turns, and the single or varied gauge of wire can be of the designers choice for producing the desired tone from the tap point, as such it is noted that the above example of turns and wire diameters is given merely for descriptive purposes and should not be considered limiting.

It still yet another particularly preferred mode of the invention, the means for variable inductance to produce variable sound signal outputs is provided by forming the coil of the pickup, with layers of varying gauge wire, with each wire having its own input and output leads. Each gauge wire can complete a desired number of turns to produce any value of induced voltage and therefor an electronic signal which amplifies to a particular tone. Again, the outputs of each of the two humbucker coils of the same gauge and turns can be wired in series such that the pickup device will have a plurality of outputs. The outputs can communicate with connectors of a multi-throw switches or can have individual audio output connections to amplifiers or sound equipment.

The device herein with differing electronic signals from different tap points, at varying points of resistance through the coil, yielding resulting increases and decreases of the induced output voltages from the variable inductance resulting at the different respective tap points of the pickup, allows for using singularly and in combination and decreasing or increasing the resonant peak provided in the sound from the same pickup. This provides for signals which when amplified will produce a plurality of tones and sounds with differing cut off points, which are all producible out of a single pickup configuration.

The device will also allow users to select and customize the tones and sounds produced by their instrument by a varying of the wire gauge, tap locations, number of turns, and other parameters. The device is only limited by the size of the components themselves and is essentially configurable to an infinite number of operative arrangements.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements. It is an object of the present invention to provide an electronic pickup device employable with conventional stringed instruments.

It is an object of the present invention to provide a guitar pickup device employable in a single pickup configuration along the length of the strings.

It is an object of the present invention to provide a guitar pickup device employable in a humbucker type pickup configuration.

It is an object of the invention to provide a pickup device having a plurality of output signal lead wires, each communicating at different tap points of the coil and having different induced voltages, from a single coil configuration of the pickup and thereby producing different tones and sounds from the amplified signals of each lead.

It is another object of the invention to provide a coil configuration having a plurality of tap wires extending from varying tap locations positioned at different lengths along the entire length of the wire forming the coil.

It is another object of the invention to provide a pickup having a coil formed from wraps of a wire comprised of individual aggregate portions, some or all of varying gauge and aggregate length of the wire.

It is an object of the invention to provide a means for selectively designing tones and sounds produced by the pickup by the varying signals from the pickup from varying the wire gauge, tap locations, number of turns, and other parameters.

It is yet another object of the invention to allow a user to select from one or a plurality of output signals through the provision of one or a plurality of throw-switches or adjustable knob switches such as potentiometers and line input balance controls.

These and other objects, feature, and advantages of the invention will be brought out in the following part of the specification, wherein detailed description is for the purpose of fully disclosing the invention without placing limitations thereon.

BRIEF DESCRIPTION OF DRAWING FIGURES

The accompanying drawings, which are incorporated herein and form a part of the specification, illustrate some, but not the only or exclusive, examples of embodiments and/or features. It is intended that the embodiments and figures disclosed herein are to be considered illustrative rather than limiting. In the drawings.

Figure 4A:
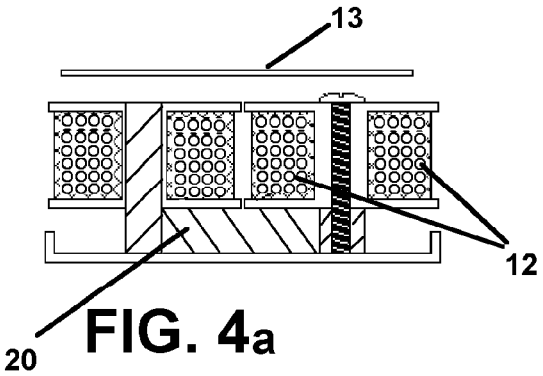
FIG. 4 shows a side cross sectional view of another preferred mode of the variable inductance means provided by winding the coil with various layer of varying gauge wire.

FIG. 4*a* depicts a typical single coil pickup in which the device and method herein may be employed.

Figure 4B:
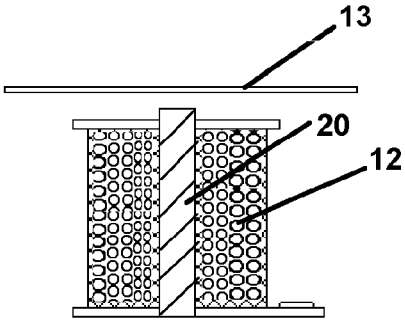

FIG. 4*b* shows a typical humbucker style pickup in which the device and method herein may be employed.

Figure 5:
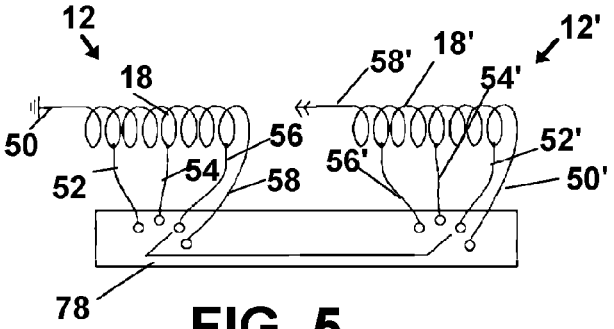

FIG. 5 shows a schematic view of a first preferred wiring of the input and output leads of the mode of the device employing a plurality of tap wires, having a double throw switch.

Figure 6:
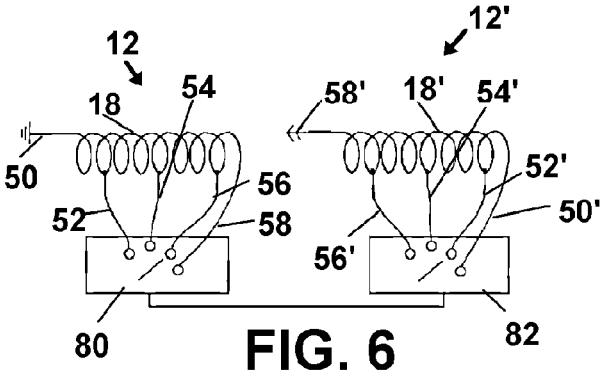

FIG. 6 show a schematic view of another preferred wiring of the input and output leads of the taps employing an individual switch per coil.

Figure 7:
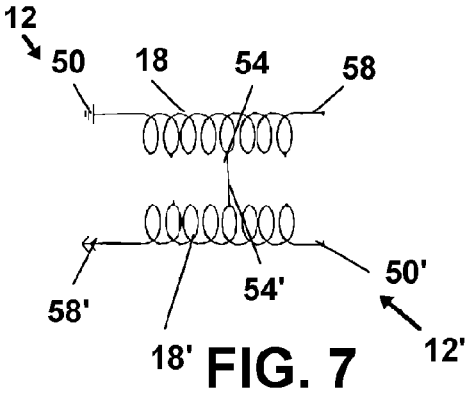

FIG. 7 show a schematic view of still another preferred wiring of the input and output leads of the taps with the corresponding taps of each coil engaged directly together.

Figure 8:
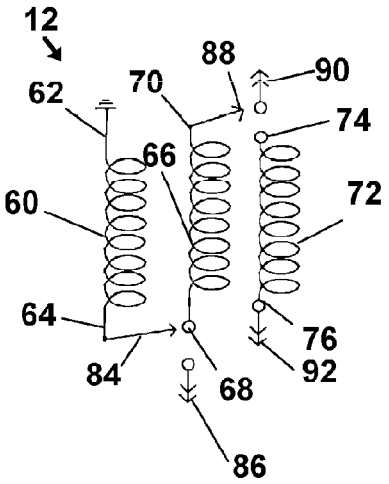

FIG. 8 shows a schematic view of a first preferred wiring of the input and output leads of the mode of the device employing layers of varying gauge wire.

Figure 9:
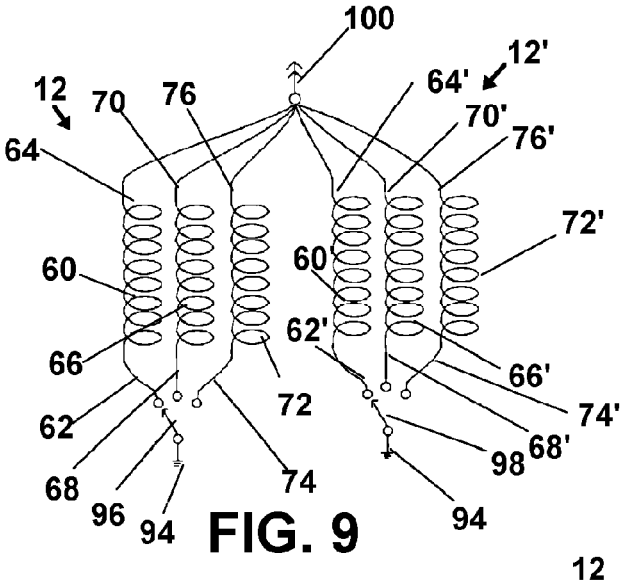

FIG. 9 shows a schematic view of another preferred wiring of the input and output leads of the mode of the device employing layers of varying gauge wire.

Figure 10:
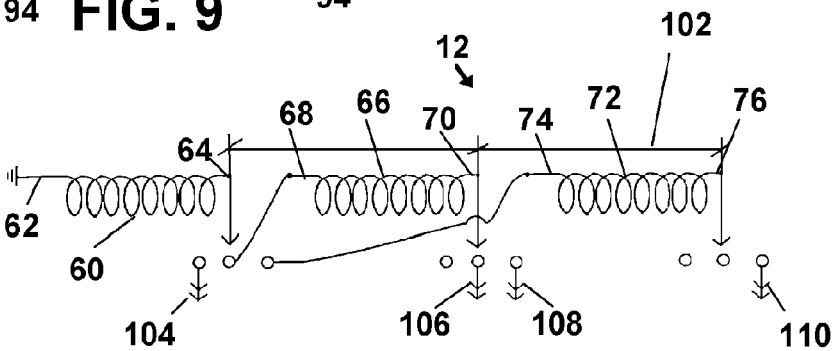

FIG. 10 shows a schematic view of a still another preferred wiring of the input and output leads of the mode of the device employing layers of varying gauge wire.

Figure 11:
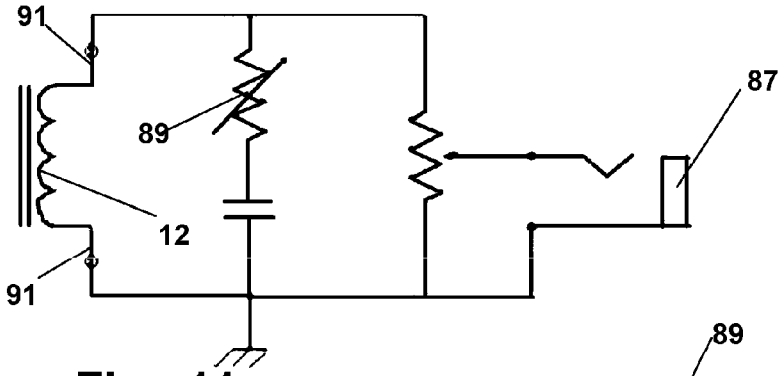

FIG. 11 shows a conventional knob adjustable resistive potentiometer forming variable circuit which receives signals from the pickup, and communicates them to a jack engaged to an amplifier. An adjustment of the rotatable potentiometer changes the signal reaching the jack.

Figure 12:
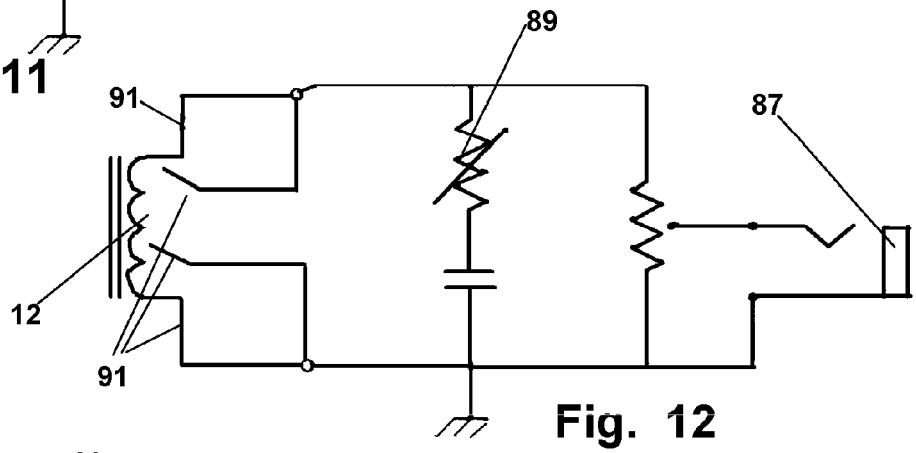

FIG. 12 depicts a mode of the device herein having four tap wires communicating to the knob adjustable circuit of FIG. 11.

Figure 13:
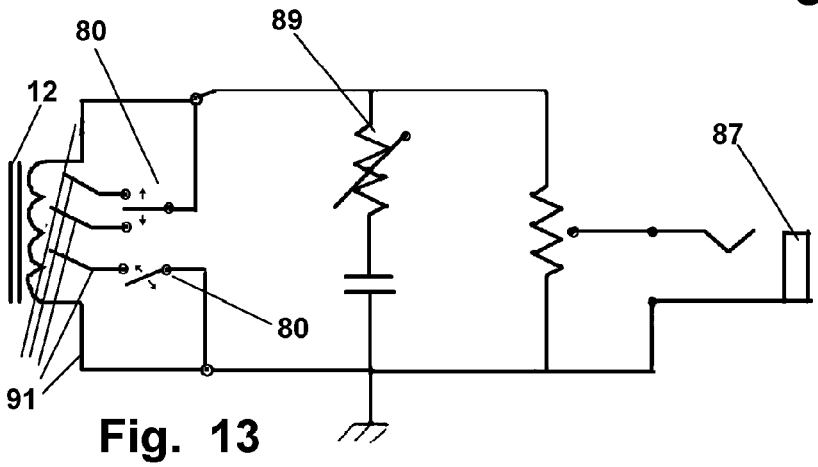

FIG. 13 depicts a mode of the device having five tap wires communicating from 5 tap positions where two of the tap wires communicate to respective sides of the resistive potentiometer and a pair of switches allows for inclusion of between zero and two extra tap wires into the circuit.

Figure 14:
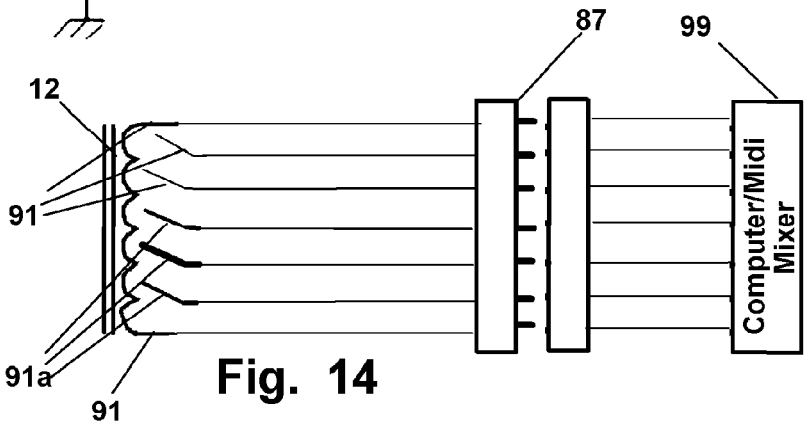

FIG. 14 depicts a mode of the device having a plurality of seven tap wires communicating from different tap positions on the coil where two wires are of the same diameter and three have different diameters and all are communicated directly to a mixer or computer device adapted for input and mixing the differing sounds from the different tap wires.

DETAILED DESCRIPTION OF THE PREFERRED EMBODIMENTS OF THE INVENTION

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation.

Figure 1:
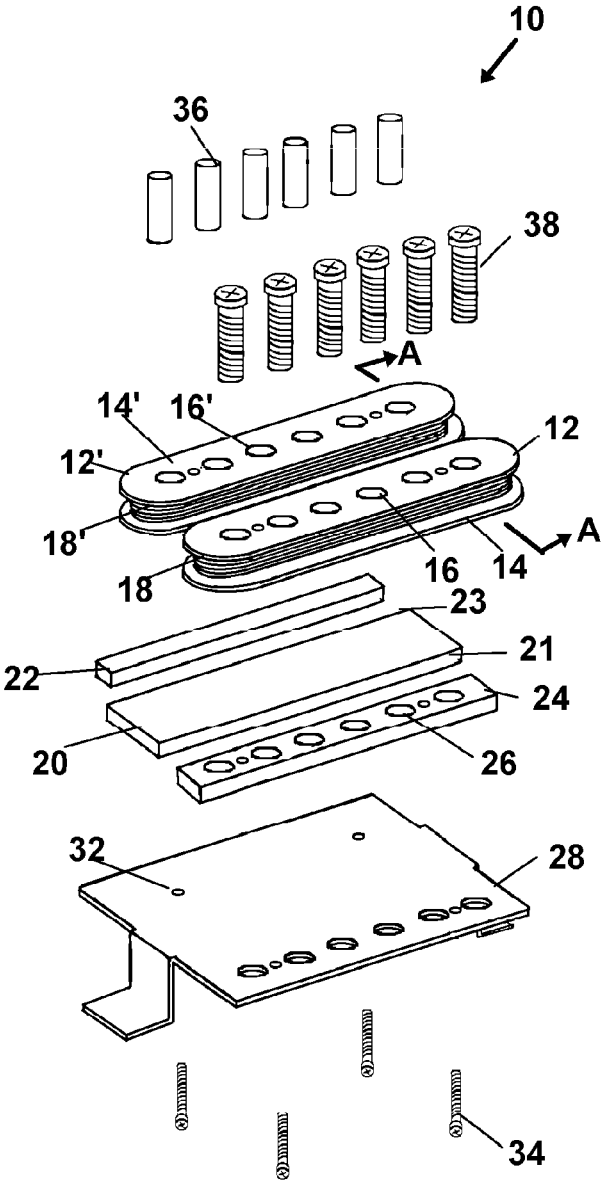
FIG. 1 shows an exploded view of a first preferred mode of the variable inductance guitar pickup employed in a typical humbucker-type coil configuration.

Now referring to drawings in FIGS. 1-14, wherein similar components are identified by like reference numerals, there is seen in FIG. 1 an exploded view of a preferred mode of the variable inductance guitar pickup device 10. In this mode, the device 10 is generally configured as a type of humbucker pickup, wherein two coils 12, and 12' are positioned in an engagement on permanent bar magnet 20. However, it is noted that in other modes the device 10 may be configured as a single pickup type, wherein only one coil configuration is positioned in an operative engagement with the magnet 20.

The configurations of the coil 12, 12' are generally comprised of a non magnetic elongated bobbin 14, having a plurality of apertures 16, 16' communicating therethrough, and a wire 18, 18' wrapped around the bobbin 14 forming a coil 12 circuit as shown. However, it is noted that in the figure the lead ends of the wires 18, 18' are not shown merely for clarity, however, in actuality a plurality of lead ends of the coil circuit are present, as will be described in more detail later.

A plurality of adjustable pole pieces, comprising a first set of pole pieces, herein provided by adjustable ferromagnetic screws 38, communicate through the threaded apertures 16 of the first coil 12, and extend to an engagement with a ferro magnetic spacer 24, also having corresponding apertures 26. The spacer 24 contacts the magnet 20 and therefor the spacer 24 and screws 38 are in a magnetic communication with the magnet 20.

the apertures 16' of the second coil 12' are configured to engage a plurality of fixed pole pieces, comprising a second set of pole pieces, herein provided by a plurality of ferromagnetic slugs 36. The slugs 36 extend through the apertures 16' such that the sidewalls of the slugs 36 will contact the north magnetic pole 23 edge of the magnet 20. A additional non magnetic spacer 22 is provided to maintain the bottom of the bobbins 14' in the plane flush with the top surface of the magnet 20.

In use, the first coil configuration 12 is positioned on the south magnetic pole 21 edge of the magnet 20, and the second coil configuration 12' is positioned on the north magnetic pole 23 edge of the magnet 20, as is convention with humbucker type pickups. Thus, the ferromagnetic slugs 36 of the second configuration 12' will exhibit a magnetic field polarity in relation to the north magnetic pole 23 while the ferromagnetic screws 38 of the first configuration 12 will exhibit a magnetic field polarity in relation to the south magnetic pole 21, with each being equal and opposite polarities.

However, it is noted and anticipated that those skilled in the art may envision other means for magnetically polarizing the pole pieces. For example the equal and opposite polarity attribution of the slugs 36 and screws 38 can instead be accomplished by employing slugs 36 and screws 38 which are themselves magnetized, and oriented in their engagement with the bobbins 14, 14' in an opposing magnetic polarity relationship, without the need for the permanent magnet 20.

In all preferred modes, an the as used mode is provided. As is convention with pickup devices known in the art, the as used mode is when the device 10 is engaged to a conventional stringed instrument, such as an electric guitar, with each of the pole pieces substantially aligned adjacent to a respective string of the instrument. Thus the vibration of each individual string will disturb the magnetic field of each pole piece, thereby inducing a voltage in the coils, as described previously.

The coils 12, 12' are engaged to a baseplate 28 via conventional mounting methods, for example, a plurality of engagement screws 34 may extend through the apertures 32 in the baseplate 28 and mechanically and securely engage the coils 12, 12' thereon.

It is noted that the depicted configuration of the device 10 as a humbucker type pickup is provided merely as one preferred mode, and other configurations of pickups which those skilled in the art may recognize, such as single coil pickups, or combinations thereof, may also be employed, and are anticipated. At that end, it is noted that the utility of the device 10 providing a variable inductance means is provided by the configurations of the windings 18, 18' of the coils 12, 12' described in later figures which depict the multiple tap wires extending from a plurality of tap positions as shown in FIGS. 4-10.

Figure 2:
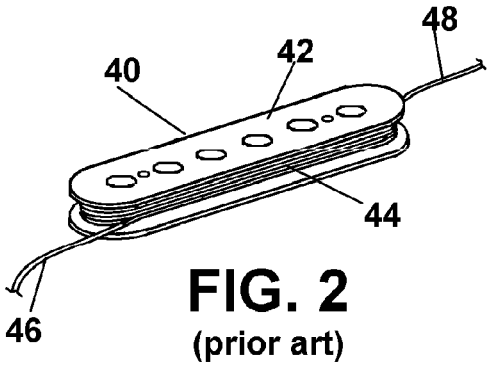
FIG. 2 (prior art)
FIG. 2 shows a example of a conventional guitar pickup coil configuration having a single input lead and single output lead.

In contrast to the device 10 herein, FIG. 2 shows a view of a conventional prior art coil configuration 40 as would be seen in a single coil or half of a humbucker type pickup. The coil 40 consists of a bobbin 42 and a winding of a wire 44. As is shown the wire 44 forms a circuit conventionally having two leads, that is, a input lead 46 and an output lead 48. The leads 46, 48 are employed in conventional circuitry to an audio output for amplification. These conventional coil configurations 40 are limited in customized in tone and sound merely by variance of the wire 44 material type, gauge, and number of turns of the wire 44. These parameters will vary the resistance of the coil, the induced voltage, and therefor the tone when the strings 13 are plucked. However, such changes require complete modification of the coil 40 and is therefor extremely limited.

The utility provided by the disclosed device 10 herein provides the user with the ability to render the sound produced by their stringed instrument, in particular a guitar, to an unlimited number of modes by providing the ability to receive signals to generate music from an unlimited number of coil types and windings within a bobbin/coil configuration. One such configuration is by positioning a plurality of tap wire leads, extending from a connection at a respective plurality of tap locations, positioned at various locations along the length of the wire forming the coil 12. The user can further modify the coil circuitry by varying the coil wire material, the wire gauge, and the wire length between each tap location, thereby varying the induced voltage drawn at each tap wire lead. Those skilled in the art will recognize the almost infinite number of possible configurations for positioning of tap wire leads, and changing wire lengths and diameters which are within the scope of this patent, while some preferred modes which are described below, should not be considered as imply limitations thereon.

Figure 3:
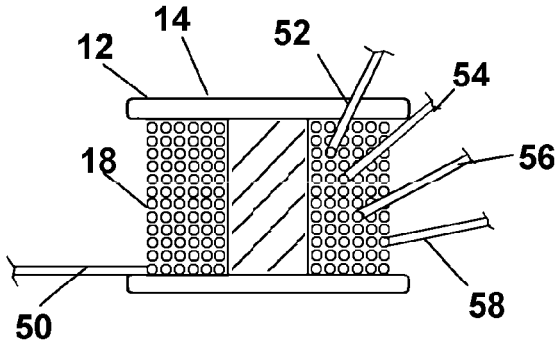
FIG. 3 shows a side cross sectional view of one of the coil configurations of FIG. 1 along line AA of FIG. 1, showing a first preferred mode of the variable inductance means provided by a plurality of lead wires extending from various tapped locations along the winding of the coil of the device.

With that being said, FIG. 3 depicts one preferred mode of the device 10 providing variable means of inductance through multiple tap positions. The device 10 by providing multiple tap positions for multiple tap wires 52-58, provides a means for drawing varied individual induced voltages, and thus individual tones from the amplified individual electronic signals, out of a single coil configuration. Conventionally this cannot be accomplished without removing and changing the coil 12 to one adapted to generate the electronic signal desired for amplification for the desired sound.

The number in the plurality of tap wires 52-58 in different positions and can be user defined. It should be noted, that with a plurality of individual signals communicating along the respective individual tap wires 52-58 from different points on the coil 12, the entire plurality may be communicated as individual signals into a multi-line amplifier, or through a preamp or signal processing component such as a MIDI component such as in FIG. 14, which would enable the user to feed all the individual signals separately into a mixing device 99 (FIG. 14), such as a computer, or mixing board, configured with music generation and mixing program for employment in making music live or in recordings.

Thus instead of a conventional single hot lead and ground providing the electronic signal to an amplifier or mixer or computer, the device 10 herein can provide one, two, or twelve, or any number of tap lead wires each of which communicating differing electronic musical signals from the signal generation of the string in the magnetic flux at the different tap points along the coil 12. As such, all modes of the device 10 herein, while described as mixing and providing a signal wire of mixed or a singular tapped signal from the coil 12, can also be provided directly from the guitar or stringed instrument, to a multi line amplifier, mixer, or computer (FIG. 14) capable of multiple tracks, whereby the multiple signals may be employed together, or singularly, depending on the user. For live shows, such multiple individual music generating feeds would allow software switching of the communicated sound to the audience, to achieve a desired effect, and provide the mixing board personnel a valuable tool in "tuning" the sound of the instruments of the band to the indoor or outdoor venue.

It is noted that the figure currently shows a cross section of the first coil 12 configuration, however the provisions and features described immediately below also apply to the second coil 12'. In this mode, variable inductance is provided by a plurality of wire taps 52, 54, 56 which are engaged to and extend from various wire tap locations along the winding of the wire 18 about the bobbin 14.

A first end 50 of the wire 18 represents the input lead wherein the wire 18 is then wound around the bobbin 14 in thousands, or tens of thousands of turns, to an output lead 58. However, during the winding, as shown, a first tap 52 is engaged to the wire 18 after a particular number of turns at a first tap position, (this particular number being a fraction of the total anticipated number of turns of the wire 18, as deemed suitable by the designer). The means for electrical engagement can include soldering or any other suitable means.

As such, the tap wire 52 acts as an output lead which will communicate a signal generated by a certain induced voltage and a particular tone relative to the number of turns of the wire 18 preceding the tap wire 52 connection at the tap point. The number of turns of the wire 18 preceding the tap point for the tap wire 52 can be of the designers choice and can be selectively chosen to produce any desired tone and sound.

Following the engagement of the first tap wire 52, the wire 18 continues to wind the bobbin 14 in a conventional manner. However, after another particular determined number of winds of the wire 18 (this particular number being any fraction of the total anticipated turns), a second tap wire 54 is engaged to the wire 18 at a second tap point and communicated out of the bobbin 14. This tap wire 54 also provides a output signal corresponding to the number of turns of the wire 18 between the tap 54 and the input 54 (it is noted that this includes the number of turns before and after the first tap 52, and up to the location of the second tap 54).

To this end, an additional third tap wire 56 may also be provided at a third tap point, after another particular number of turns of the wire 18, which will communicate a different induced voltage from the tap point which will when amplified generate a different tone or note than those of the first and second tap wires 52, 54. Upon a completion of winding of the wire 18, a final output lead 58 is provided, which comprises the entire length of the wire 18, from input lead 54 to output lead 58.

The configuration as described above provides a plurality of tap wires providing a plurality of electrical signal outputs, each corresponding to a different value of the induced voltage at the respective tap point after a determined number of turns of a wire 18 forming the coil 12, wherein each different induced voltage when amplified will produce a different tone or sound frequency.

It is noted that it is merely the designer's choice of the number of tap points and communicating tap wires, the number of turns between taps, as well as wire 18 and tap material and size, as each variable will allow the user to customize the electronic signal generated and the sound and tone produced during amplification or recording. Further, it is noted and anticipated that the wire 18 material itself, and the diameter or gauge size may be varied for lengths of the wire 18 between the tap point locations. Such variance further allows the user to customize the induced voltage and therefor the tone produced at each tap point.

Those skilled will recognize that within the scope of this invention the provision of taping a wire at intervals of varying number of turns will allow for an infinitely customizable guitar pickup, which is only limited by the size of the bobbin 14, magnet 20, and length of wire 18. As such the description is merely provided to portray the scope and intent of the invention and should not be considered limiting. To that end, preferred wiring configuration are described in later figures, and are merely examples of preferred modes, while other wire configurations which are suitable within the scope of this disclosure may be employed and are anticipated as part of this patent.

Figure 4:
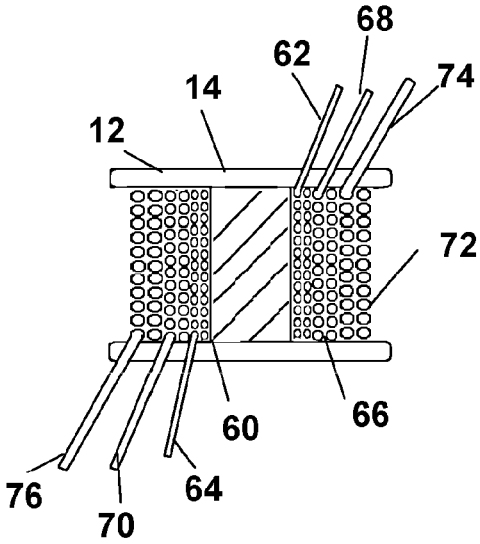

FIG. 4 shows yet another preferred mode of the variable inductance means of the present invention. In this mode, varying individual induced voltages may be drawn from a single coil 12 configuration by providing windings with lengths or layers of wire of varying conductive material and/or size (gauge). In the figure, there is currently shown three layers of wound wire, 60, 66, 72, however more or less may be employed.

A first layer of wire 60, closest to the magnet, may be constructed by winding the wire about the bobbin 14 and maintaining a input lead 62 and output lead 64 exterior the bobbin 14. The first layer 60, for example may be a conventional 42 AWG copper wire, which is wound at any desired number of turns.

A second layer winding 66 positioned adjacent to the first on the opposite side of the first layer 60 from the magnet 20 may also be provided, again maintaining a input lead 68 and output lead 70 exterior the bobbin 14 for electrical connect later. For example, the second layer 66 may be a conventional 44 AWG copper wire, which is wound at any desired number of turns. Further, a third layer 72, furthest from the magnet 20, is also provided having an input lead 74 and out lead 76. The third layer 72 for example may be a 46 AWG copper wire, and again wound at any desired number of turns determined by the designer. As such, this mode essentially provides the user with a plurality of different coil configurations formed in one bobbin.

It is noted that the number of wire layers, the wire gauge and the wire material type, are solely the designers choice as needed to produce a selected induced voltage and therefor tone. As such the description of the figure should be considered merely as an example for demonstrative purposes and should not be considered limiting. Still further, it is anticipated that in other mode, the plurality of wires may instead by configured in a side-by-side stacked arrangement, as opposed to a layer configuration shown in the figure.

FIG. 5-7 show schematic views of preferred wiring configurations of the mode of the device of FIG. 3. It is noted that the preferred wiring configurations and are generally humbucking configurations as to eliminate EMI and hum in the amplified sound. As shown, the windings of the wires 18, 18' forming the coils 12, 12' are shown as simple linear wire coils in the schematics merely for descriptive purposes. As such those skilled in the art will immediately recognize the implications of the schematics and how they carry to actual construction of the device 10. The schematic drawings additionally show how a switch, or adjustable knob may be employed to allow the user to select any of the output leads as needed for tuning the produced sound and tone such as in FIGS. 11-13.

In FIG. 5, and accordance with the first preferred wiring configuration, the tap wires 52, 52', 54, 54', 56, 56' leading from individual tap points along the coils 12, 12' respectively are engaged in series and communicate via a dual throw switch 78.

The input lead 50 of the first coil 12 is maintain as a common ground for the electrical circuit and the output lead 58 of the second coil 12' is considered the output of the circuit and conventionally referred to as a 'hot output' or 'hot common'. This wire configuration allows the user to selectively chose which tap wire to the signal for amplification draw from, and as can be clearly seen in the figure, the dual throw switch 78, maintains continuity between the taps of the two coils 12, 12'.

FIG. 6 shows another preferred wiring configuration wherein each coil 12, 12' has an individual switch 80, 82. As such the user can make a different tap wire selection for each coil 12, 12' to communicate to an amplifier to produce a desired tone/sound.

FIG. 7 shows still another preferred wire configuration wherein the user can directly engage the desired tap wires to tap positions on the coils 12, 12' in fixed electronic engagement, such as by soldering. Currently shown the second tap wires 54, 54' of each coil 12, 12' are in fixed electrical engagement. However it is noted that the configuration of fixed engagement can be of the designers choice and should not be considered limiting.

FIG. 8-10 show schematic views of preferred wiring configurations of the mode of the device of FIG. 4. FIG. 8 currently depicts a view of a wiring configuration for the first coil 12, however it is noted that the wiring of the second coil 12' will be substantially similar. The end lead 62 of the first wire layer 60, is maintained as a common ground. The output lead 64 of the first layer 60 is engaged to switch 84 which will allow the user to communicate the signal induced in the first layer 60 to a hot common 86, or in series to the input 68 of the second layer 66. The output 70 of the second layer 66, additionally includes a switch 88 which allows the user to communicate the voltage induced signal to either a hot common 90, or in series to the input of the third layer 72. The output 76 of the third layer 72 is then communicated to a hot common output 92. As such the user can vary the induction of the coil 12 by varying the path of the signal through the wire formed each coil 12, 12' in series to one, both, or all of the layers 60, 66, 72. It is noted that additional layers may be employed in the same configuration, and one skilled in the art will recognize this.

FIG. 9 shows still another preferred wire configuration of the mode of the device 10 of FIG. 4. In this configuration, each coil 12, 12' is configured with a grounded 94 switch 96, 98 respectively, which allows the user to individually select the desired layer 60, 66, 72, 60', 66', 72 of each formed coil 12, 12' respectively. The outputs 64, 70, 76, 64', 70', 76' can extend to a hot common output 100, or can have individual outputs.

FIG. 10 shows yet another preferred wiring configuration of the mode of the device 10 of FIG. 4. This mode provides a multi-throw, multi-positionable switch 102, to allow the user to select any of a plurality of signal paths through the wire forming the coil relative various combinations of the layers 60, 66, 72 in the coil 12. It is noted that the second coil 12' will be wired similarly and have common output 104, 106, 108, 110.

FIG. 11 shows a conventional knob adjustable variable resistance circuit such as on an electric guitar, which receives electrical signals from the pickup coil 12, and communicates them to a jack 87 which is engaged to an amplifier. By adjusting a knob the resistive potentiometer 89 and tone potentiometer control of the sound generated by the signal from the coil which is communicated to the jack 87 are provided. From the jack 87, the signal communicates to an amplifier, which drives a speaker.

FIG. 12 depicts a mode of the device herein having four tap wires 91 from individual tap points on the coil 12, communicating to the knob adjustable circuit of FIG. 11.

FIG. 13 depicts a mode of the device having five tap wires communicating from 5 tap positions where two of the tap wires communicate to respective sides of the resistive potentiometer 89 and a pair of switches 80 allows for inclusion of the electronic signal from between zero and two extra tap wires 91 into the circuit in addition to the conventional two coil connections.

FIG. 14 depicts a mode of the device having a plurality of seven tap wires 91 communicating from different tap positions on the coil 12 where four tap wires 91 come from wire sections on the coil 12 which are of the same gauge, and three tap wires 91*a* are engaged with sections of the wire forming the coil 12 which are of lengths of different gauges, or have different diameters and will vary the induced electronic signal.

Additionally, as shown, all the tap wires 91 and 91*a* are communicated through a jack 87 or similar connection means directly to a mixing device 99 such as a computer or mixing board or midi device adapted for input and mixing the differing sound produced by the electronic signals from the plurality of different tap wires 91. This direct communication of individual signals from individual tap wires 91 can be employed with any of the embodiments of the device 10 herein.

This invention has other applications, potentially, and one skilled in the art could discover these. The explication of the features of this invention does not limit the claims of this application; other applications developed by those skilled in the art will be included in this invention.

It is additionally noted and anticipated that although the device is shown in its most simple form, various components and aspects of the device may be differently shaped or slightly modified when forming the invention herein. As such those skilled in the art will appreciate the descriptions and depictions set forth in this disclosure or merely meant to portray examples of preferred modes within the overall scope and intent of the invention, and are not to be considered limiting in any manner.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed:

1. A pickup configured for engagement to a body of an instrument having metal strings, to an as-used position proximate to said strings, comprising:

a coil structure comprising a plurality of loops of a wire, said loops defining a conducting pathway extending from a first end of said wire to a second end of said wire;

said coil structure defining a recess surrounded by said plurality of loops of wire, a portion or all of a magnetic member positioned within the recess;

said magnetic member configured to project a magnetic field sufficient to magnetize the strings of said;

an electrical current in said coil wire induced by a movement of at least one of said strings, generating first electrical signal from said first end of said wire, and a second electric signal from said second end of said wire;

an electrical connection configured to communicate said first electrical signal and said second electrical signal to an electronic component for amplification or electronic mixing;

said first electronic signal in an electrical engagement with a first conductor of said electrical connection;

said second electronic signal in an electrical engagement with a second conductor of said electrical connection;

at least one tap wire having a first end electrically connected to said conducting pathway at a tap point at one of said plurality of windings, said tap point located between said first end and said second end of said coil wire;

said electrical current in said coil wire induced by said movement of said strings within said magnetic field, generating a communication of an additional electronic signal from said coil wire at said tap point, to a second end of said tap wire; and a switch, said switch being in electrical communication with said first conductor and said second conductor and said second end of said tap wire,said switch being operable to electrically connect said second end of said tap wire with either of said first conductor or said second conductor for communicating said additional electronic signal to one of, said first conductor of said electrical connection, or said second conductor of said electrical connection.

2. The pickup device of claim 1, additionally comprising:

said plurality of loops of a wire, engaged in a pathway around a circumference of a bobbin; and said bobbin having an interior aperture defining said recess.

3. The pickup device of claim 1, additionally comprising:

a plurality of sets of pole pieces equal to a number of said strings;

first ends of said pole pieces positioned proximate to said magnetic member providing means for magnetically polarizing said pole pieces;

said pickup in said as-used position, positioning one each of individual respective second ends of said pole pieces, adjacent to a respective one of said strings;

said magnetic member projecting said magnetic field sufficient to magnetize the strings through said pole pieces; and whereby said electrical current is induced in said coil wire by a said movement of at least one of said strings, adjacent to one of said second ends of said pole pieces.

4. The guitar pickup device of claim 3 additionally comprising:

said coil structure of said plurality of loops of said wire, defining said conducting pathway, being formed in successive layers of said loops of said wire, surrounding said recess;

a first layer of said plurality of loops of wire being formed of said wire in a first gauge;

a second layer of said plurality of loops of wire surrounding said first layer being formed of a second gauge of said wire, said second gauge being larger or smaller than said first gauge;

said tap point positioned at a transition point of said wire along said conductive pathway from said first gauge of said first layer to said second gauge of said second layer; and said successive layers of said wire in said first gauge and said second gauge providing means for varying the induced voltage in portions of said conductive pathway in said first layer from the induced voltage of said second layer.

5. The guitar pickup device of claim 2 additionally comprising:

said coil structure of said plurality of loops of said wire, defining said conducting pathway, being formed in successive layers of said loops of said wire, surrounding said recess;

a first layer of said plurality of loops of wire being formed of said wire extending from a first end, and terminating at a second end engaged with said first said tap point;

said first tap point connected to a first end of a said first tap wire;

a second end of said first tap wire extending from said coil;

a second layer of said plurality of loops of said wire, said second layer having a first end extending from said coil from a position adjacent to said first tap point, said second layer surrounding said first layer and having a second end of said wire forming said second layer terminating at a second tap point;

a first end of a second tap wire engaged to said second tap point;

a second end of said second tap wire exiting from said coil;

a third layer of said plurality of loops of said wire, said third layer having a first end extending from said coil from a position adjacent to said second tap point, said third layer surrounding both said first layer said second layer, and having a second end of said wire forming said third layer terminating exterior to said coil;

a switch having a first position and a second position;

said switch in said first position connecting said second end of said first tap wire to said first end of said wire forming said second layer, and connecting said second end of said second tap wire to said first end of said wire forming said third layer;

said switch in said second position connecting said second end of said first tap wire to said first end of said wire forming said third layer;

said conductive pathway formed by said wire forming said first layer and said second layer and said third layer with said switch in said first position;

said conductive pathway formed by said wire forming said first layer and said third layer with said switch in said second position; and a changing of said switch between said first position and said second position providing means for varying the induced voltage in said conductive pathway and concurrent change in the first electrical signal from said first end of said wire, and a second electric signal from said second end of said wire forming said conductive pathway.

6. A pickup configured for engagement to a body of an instrument having metal strings, to an as-used position proximate to said strings, comprising:

a coil structure comprising a plurality of loops of a wire, said loops defining a conducting pathway extending from a first end of said wire to a second end of said wire;

said coil structure defining a recess surrounded by said plurality of loops of wire, a portion or all of a magnetic member positioned within the recess;

said magnetic member configured to project a magnetic field sufficient to magnetize the strings of said;

an electrical current in said coil wire induced by a movement of at least one of said strings, generating first electrical signal from said first end of said wire, and a second electric signal from said second end of said wire;

an electrical connection configured to communicate said first electrical signal and said second electrical signal to an electronic component for amplification or electronic mixing;

said first electronic signal in an electrical engagement with a first conductor of said electrical connection;

said second electronic signal in an electrical engagement with a second conductor of said electrical connection;

a plurality of tap wires each having a respective first end electrically connected to said conducting pathway at a respective said tap point at one of said plurality of windings, each said tap point located between said first end and said second end of said coil wire;

said electrical current in said coil wire induced by said movement of said strings within said magnetic field, generating a communication of an additional electronic signal from said coil wire at said tap point, to a second end of said tap wire; and an electrical connector operatively connected with said second end of said tap wire for communicating said additional electronic signal to one of, said first conductor of said electrical connection, said second conductor of said electrical connection;

said electrical current in said coil wire induced by said movement of said strings within said magnetic field, communicating an individual respective said additional electronic signal, from said coil wire at each said respective tap point, to each respective said second end of each respective one of said plurality of said tap wires; and said electrical connection having a respective additional said conductor communicating to said electronic component for amplification or electronic mixing, each respective said additional conductor having a respective electrical engagement with one respective said second end of one of said plurality of said tap wires;

each said additional conductor providing a pathway to communicate a said respective said additional electronic signal from a respective second end of a said tap wire, to said electronic component, whereby each respective said electronic signal from each respective additional said tap wire, is communicable to said electronic component along a respective individual said conductor.

7. The pickup device of claim 6, additionally comprising:

said respective electrical engagement of each respective said additional conductor having with one respective said second end of one of said plurality of said tap wires being a cable connector engaged on a first end to a plurality of said conductors and on a second end engageable to said first end with corresponding individual said tap wires from said plurality of tap wires.

8. A pickup configured for engagement to a body of an instrument having metal strings, to an as-used position proximate to said strings, comprising:

a coil structure comprising a plurality of loops of a wire said loops defining a conducting pathway surrounding a circumference of a bobbin, said conducting pathway extending from a first end of said wire to a second end of said wire;

said bobbin having an interior aperture defining a recess;

a portion or all of a magnetic member positioned within the recess;

said magnetic member configured to project a magnetic field sufficient to magnetize said metal strings;

an electrical current in said coil wire induced by a movement of at least one of said strings, generating first electrical signal from said first end of said wire, and a second electric signal from said second end of said wire;

an electrical connection configured to communicate said first electrical signal and said second electrical signal to an electronic component for amplification or electronic mixing;

said first electronic signal in an electrical engagement with a first conductor of said electrical connection;

said second electronic signal in an electrical engagement with a second conductor of said electrical connection;

at least one tap wire having a first end electrically connected to said conducting pathway at a tap point at one of said plurality of windings, said tap point located between said first end and said second end of said coil wire;

said electrical current in said coil wire induced by said movement of said strings within said magnetic field, generating a communication of an additional electronic signal from said coil wire at said tap point, to a second end of said tap wire; and an electrical connector operatively connected with said second end of said tap wire for communicating said additional electronic signal to one of, said first conductor of said electrical connection, said second conductor of said electrical connection;

said plurality of loops of a wire, engaged in a pathway around a circumference of a bobbin;

said bobbin having an interior aperture defining said recess;

said coil structure of said plurality of loops of said wire, defining said conducting pathway, being formed in successive layers of said loops of said wire, surrounding said recess;

a first layer of said plurality of loops of wire being formed of said wire in a first gauge;

a second layer of said plurality of loops of wire surrounding said first layer being formed of a second gauge of said wire, said second gauge being larger or smaller than said first gauge;

said tap point positioned at a transition point of said wire along said conductive pathway from said first gauge of said first layer to said second gauge of said second layer; and said successive layers of said wire in said first gauge and said second gauge providing means for varying the induced voltage in portions of said conductive pathway in said first layer from the induced voltage of said second layer.

* * * * *